US009928679B1

(12) United States Patent
Chan

(10) Patent No.: US 9,928,679 B1
(45) Date of Patent: Mar. 27, 2018

(54) DEVICE FOR THE OUTPUT OF NOTES OF VALUE WITH AN ADJUSTABLE GUIDE ELEMENT

(71) Applicant: Wincor Nixdorf International GmbH, Paderborn (DE)

(72) Inventor: Darren Chan, Singapore (SG)

(73) Assignee: Diebold Nixdorf, Incorporated, North Canton, OH (US)

( * ) Notice: Subject to any disclaimer, the term of this patent is extended or adjusted under 35 U.S.C. 154(b) by 0 days.

(21) Appl. No.: 15/709,619

(22) Filed: Sep. 20, 2017

(30) Foreign Application Priority Data

Sep. 20, 2016 (EP) ..... 16189627

(51) Int. Cl.
*B65H 31/30* (2006.01)
*G07D 11/00* (2006.01)
*B65H 31/36* (2006.01)

(52) U.S. Cl.
CPC ..... *G07D 11/0027* (2013.01); *B65H 31/3081* (2013.01); *B65H 31/36* (2013.01)

(58) Field of Classification Search
CPC .... B65H 31/20; B65H 31/30; B65H 31/3081; B65H 31/36; B65H 2404/73; B65H 2404/7412; B65H 2404/7414
See application file for complete search history.

(56) References Cited

U.S. PATENT DOCUMENTS 2,988,236 A * 6/1961 Shields ..... B65H 29/14 271/212
4,311,475 A * 1/1982 Imai ..... B42C 19/08 271/218
2009/0166957 A1 7/2009 Kong et al.
2015/0254920 A1 9/2015 Chow et al.

FOREIGN PATENT DOCUMENTS

CN 103914905 A 7/2014

OTHER PUBLICATIONS

Machine Translation of CN103914905 A abstract.
European Search Report dated Apr. 6, 2017 for corresponding application EP 16 18 9627.
Machine Translation of CN103914905A.
European Search Report and Opinion dated Apr. 6, 2014, for corresponding European Application No. 16189627.9.

* cited by examiner

*Primary Examiner* — David H Bollinger
(74) *Attorney, Agent, or Firm* — Black, McCuskey, Souers & Arbaugh, LPA

(57) ABSTRACT

A device for the output of notes of value includes a stacking unit for stacking notes of value to a value note stack, an output compartment for the output of the value note stack to a user of the device, as well as a transport unit with a pushing plate for the transport of the value note stack from the stacking unit to the output compartment. A guide element, which serves for guiding the notes of value during the stacking of the notes of value by the stacking unit, is mounted on the pushing plate.

17 Claims, 8 Drawing Sheets

DEVICE FOR THE OUTPUT OF NOTES OF VALUE WITH AN ADJUSTABLE GUIDE ELEMENT

CROSS-REFERENCE TO RELATED APPLICATIONS

This application claims priority to and the benefit of European Patent Application 16 189 627.9, filed Sep. 20, 2016, the contents of which are hereby incorporated by reference in their entirety.

BACKGROUND

This relates in general to devices for the output of notes of value.

In devices for the output of notes of value, such as automated teller machines (i.e. automated transactions machines) or automatic cash register systems (i.e. point of sale systems), the notes of value to be output are normally offered to the user as a wad of notes of value. For this, the notes of value removed from the individual cash boxes are at first stacked by a stacking unit to a value note stack, which stack is then transported to the output compartment and is output thereat. The stacking units are usually designed such that the notes of value individually removed from the cash boxes are stacked on top of one another on a support element by vane and/or stacker wheels. Normally, this takes place at a high speed to minimize the waiting period for the user and to achieve a high throughput. It may be the case that the various notes of value of the value note stack are often not perfectly aligned with one another but project to the front and/or to the side relative to one another so that no uniform value note stack is formed. This may be problematic for the subsequent handling since the protruding notes of value may cause problems during the transport of the value note wad. In addition, an inaccurately stacked value note wad is oft considered unsightly for the customer during the output and may make a bad impression.

In known automated teller machines this situation may be partially minimized in that the stacking unit may have guide elements, in particular, for example, guide fingers, against which the notes of value are transported during stacking so that they cannot shift with respect to one another or shift only very little, and a fairly aligned value note stack is formed.

However, dependent on the currencies and/or the denominations received in the automated teller machine, as notes of value of different sizes are stacked, the position of the guide elements relative to the support element on which the notes of value are stacked may have to be adapted accordingly. If the distance of the guide elements relative to the side from which the notes of value are fed to the stacking unit is too little, then the notes of value may not be received in the stacking unit. If, on the other hand, the distance is too large, there is again the problem that the notes of value may not stacked in a perfectly or closely aligned manner.

In other known systems, the position is adapted manually, in particular such that the guide elements can be arranged in different notches of the support element of the stacking unit. This has may have disadvantage that when another currency or denomination is received in an automated teller machine, a complex, manual adaptation is required. In addition, when different denominations are handled in the automated teller machine and thus notes of value of different sizes are stacked, the largest denomination to be stacked may have to be adjusted so that, when a value note wad with a smaller denomination is stacked, the adaptation of the guide elements to the largest denomination is maintained and thus there may be an unnecessary large distance and the stacking of the notes of value of the smaller denomination may not be carried out in a most desired manner.

SUMMARY

This relates more particularly to a device for the output of notes of value, which includes a stacking unit for stacking notes of value removed from at least one value note receiving unit to a value note stack, an output compartment for the output of the value note stack, a pushing plate movable by a transport unit for the transport of the value note stack from the stacking unit to the output unit. Further, at least one guide element for guiding the notes of value during stacking by the stacking unit may be provided.

In at least one embodiment, a device for the output of notes of value achieves an output of wads of notes of value, which are stacked in a perfectly aligned manner with respect to one another.

In at least one embodiment, the guide element, via which the notes of value are guided in the stacking unit during stacking, is mounted on the pushing plate so that the guide element can be moved together with the pushing plate. Thus, it may be achieved that by adjusting the position of the pushing plate the guide element may be automatically adjusted such that the position of the guide element may automatically be adapted to the size of the respective notes of value to be stacked. Thus, a manual adjustment of the guide element may not be necessary. In addition, the position of the guide element may be adjusted with high accuracy and ease.

In at least one embodiment, the pushing plate is designed to be movable by the transport unit in a way to be able to move the value note stack to the output compartment. Thus, no other adjusting unit is required to be provided for adjusting the guide element. Rather, the adjustment may be carried out by other components of the device. In such a case, costs and/or space requirements may be minimized.

In at least one embodiment, the stacking unit may be designed such that during the stacking operation it feeds the notes of value to be stacked against the guide element. Thus, a shifting of the notes of value may be prevented and the notes of value may be stacked on top of one another in a defined position.

In at least one embodiment, the stacking unit includes at least one stacker wheel and/or at least one vane wheel, by which the notes of value are stacked on a support element. During this stacking operation, the pushing plate may be positioned such that the guide element is arranged on the side of the stacking unit opposite to the vane or stacker wheel so that a limited stacking area is defined by the guide element, which area may be adapted to the size of the notes of value so that these can be stacked on top of one another such that they are aligned with one another.

In at least one embodiment, the support element is arranged pivotably so that after termination of the stacking operation the value note stack may be moved by a corresponding pivoting of the support element into a position different from the stacking position, in which position the value note stack can then be transported by the pushing plate via the transport unit to the output compartment.

In at least one embodiment, the pushing plate is designed such that during the transport of the value note wad to the output compartment it presses against the edges of the notes of value of the value note wad and, via this contact, pushes the value note wad in the direction of the output compartment. The device may have a control unit for controlling the transport unit.

In at least one embodiment, the control unit may be designed such that it controls the transport unit such that the transport unit moves the pushing plate to different predetermined positions dependent on the currency, the denomination, and/or the size of the notes of value to be stacked. In this way, it is achieved that, dependent on the size of the notes of value to be stacked, the guide element is arranged in a different position each time, in which the distance to the feeding unit via which the notes of value are fed to the stacking unit is chosen such that, on the one hand, it is not too small and the deposit of the notes of value is not impeded, and, on the other hand, it is not too large so that a shifting of the notes of value is prevented.

In at least one embodiment, the control unit controls the transport unit such that, prior to a stacking operation, the transport unit moves the pushing plate to the position predetermined for this stacking operation dependent on the currency, the denomination and/or the size of the notes of value to be stacked.

In at least one embodiment, the pushing plate and thus the guide element remain in this position during the entire stacking operation.

As used in this example, stacking operation means the formation of a value note stack to be output.

In at least one embodiment, the position of the guide element is chosen dependent on the largest note of value of the respective value note stack.

In at least one alternative embodiment, the control unit can also control the transport unit such that the transport unit varies the position of the pushing plate during a stacking operation dependent on the currency, the denomination, and/or the size of the respective note of value to be stacked. In this way, for each individual note of value to be stacked, a size-adapted optimum position of the guide element is assumed and thus each time a guided deposit of the note of value in the desired aligned position is achieved.

In particular example, for several currencies, denominations, and/or sizes of notes of value and/or for combinations of these parameters the respective predetermined positions for the pushing plate are stored in the control unit in a clearly assigned manner. Dependent on the currency, the denomination and/or the size of the notes of value to be stacked, the control unit may read out the corresponding position and controls the transport unit such that it moves the pushing plate to this read-out position. In this way, the respective optimum position can be determined.

In further particular example, the respective predetermined positions can be determined in advance by experiment and/or determined by way of calculation in accordance with the size of the respective notes of value.

In a further example, the control unit, when the value note stack to be formed includes notes of value of different currencies, denominations, and/or sizes, selects that position of the positions predetermined for the different currencies, denominations and/or sizes in which the distance between the pushing plate and the feeding unit is the largest.

In this example, it may be that the deposit of the largest notes of value to be stacked during a stacking operation is possible without the guide element being in the way.

In a particularly preferred embodiment, the guide element is articulated to the pushing plate.

Thus, in at least one embodiment it is achieved that, via the articulation, the guide element can be deflected by the contact with other elements of the device when moving the pushing plate from the position in which it is arranged during the stacking of the notes of value in the direction of the output compartment so that the space is required during movement of the pushing plate is minimized.

In at least one embodiment, the guide element is mounted on the pushing plate such that it is movable between a first position and a second position in which it is pivoted by a predetermined angle relative to the first position. This predetermined angle may be between 60° and 100°, and is preferably between 80° and 90°. Thus, it is achieved that during the stacking of the notes of value, a guiding of the notes of value over a distance as large as possible is possible by the guide element and nevertheless during the movement of the pushing plate in the direction of the output compartment only a minimal installation space is required as a result of the pivoting of the guide element.

In at least one embodiment, the guide element is designed such that it rests against the pushing plate in the second position so that as little space as possible is required.

In at least one embodiment, when the pushing plate is arranged in one of the positions in which the pushing plate is arranged during the stacking of notes of value, the guide element is arranged in the first position. When the pushing plate, on the other hand, is moved from one of these predetermined positions in the direction of the output compartment, the articulated guide element is automatically deflected by the contact with other component parts of the device.

In at least one embodiment, the guide element is biased in the first position so that it reassumes this position automatically whenever it is not impeded to do so by the contact with other elements. Thus, it may not be necessary to provide motor elements for adjusting the guide element. The biasing may be accomplished by a spring, for example a torsion spring.

In at least one embodiment, the guide element is shaped in the form of a finger. This means that the guide element has an elongated thin structure so that it enables a guidance over a long distance with generally a volume as little as possible and thus generally with a required installation space as little as possible.

Various aspects will become apparent to those skilled in the art from the following detailed description and the accompanying drawings.

DETAILED DESCRIPTION

Figure 1:
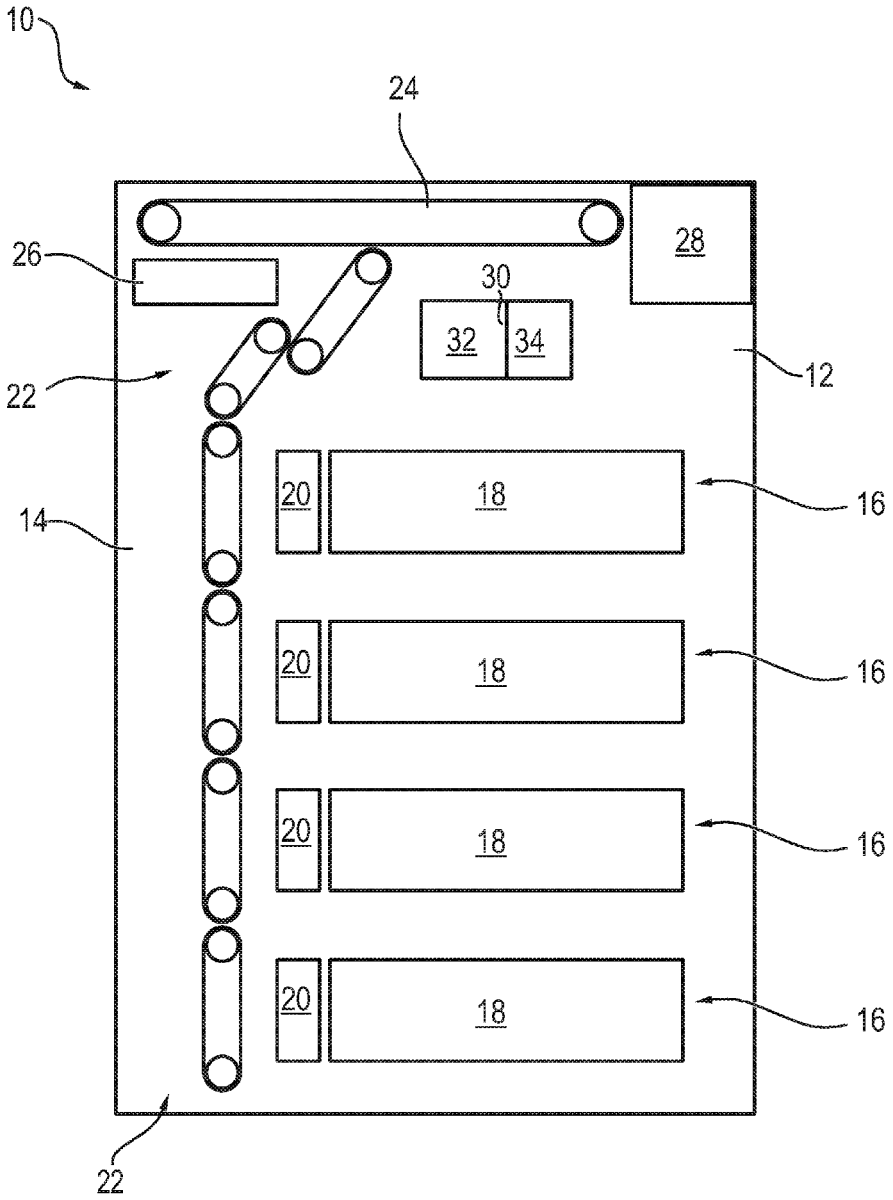
FIG. 1 in a schematic, highly simplified, illustration of an automated teller machine.

Referring now to the drawings, there is illustrated in FIG. 1 a device, shown as an automated teller machine 10, for the output of notes of value. The automated teller machine includes a head module identified with 12 as well as a safe module identified with 14, where four receiving areas 16, in each of which a cash box 18 is receivable, are provided in the safe module 14. To each receiving area 16 one pull-off and separating module 20 is assigned, by which the notes of value received in the cash boxes 18 can be removed therefrom.

The removed notes of value are transported by a first transport unit 22 into the head module 12 and to a stacking unit 26, by which they are stacked to a value note stack, where the value note wad formed in this way is then transported by a second transport unit 24 to an output compartment 28, via which the value note wad is output to a user of the automated teller machine 10.

Further, the automated teller machine 10 has a reject and retract box 30 divided into two receiving areas 32, 34 for receiving rejected and/or not removed notes of value.

Figure 2:
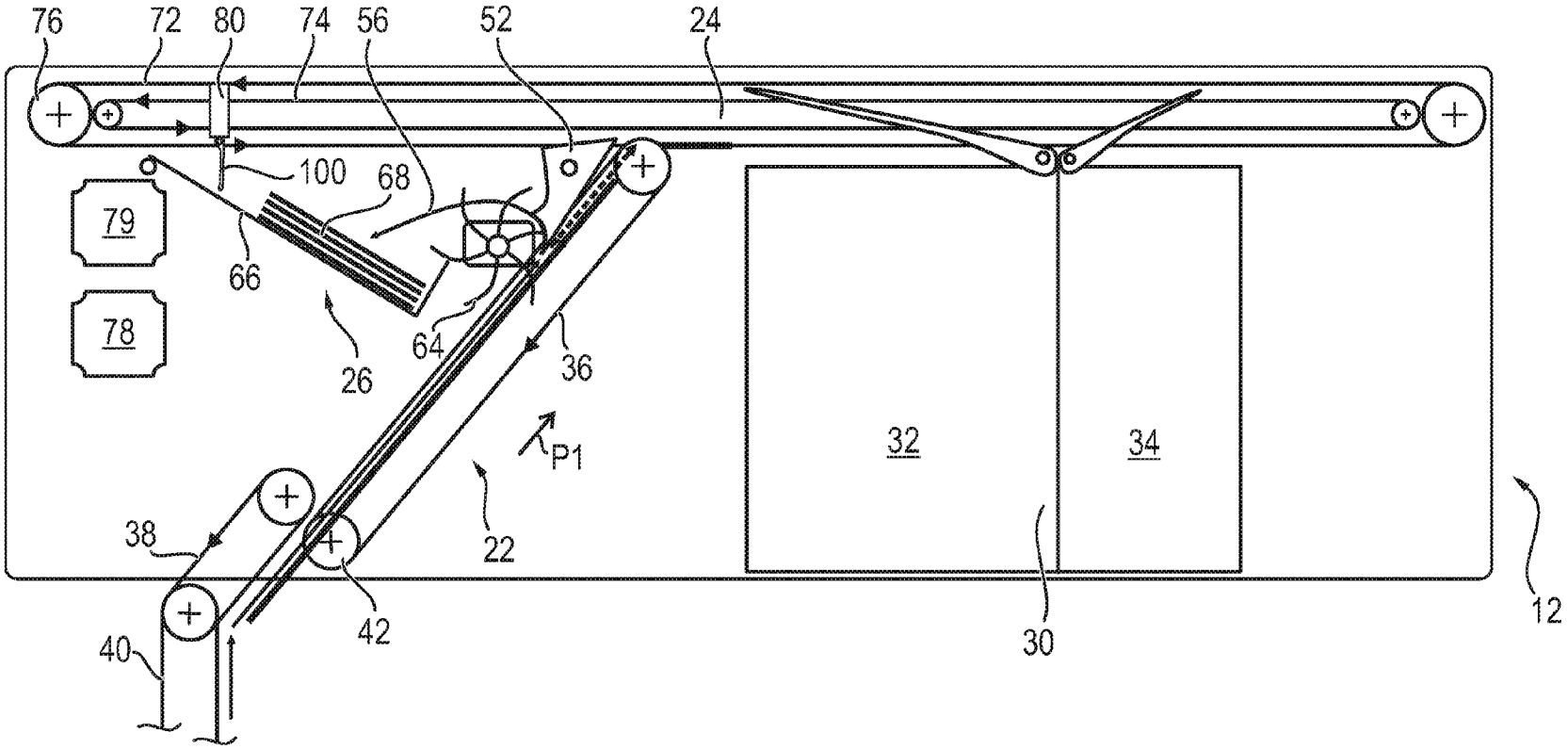
FIG. 2 is an illustration of a detail of the head module of the automated teller machine of FIG. 1.

With reference to FIG. 2, the notes of value removed from the cash boxes 18 are transported by belts 36 to 38 guided over rollers to the stacking unit 26. The belts 36 to 40 are guided over rollers 42.

The notes of value, which are to be transported to the stacking unit 26, are deflected from the transport path by a switch 58 and, as illustrated by the arrow 56, are fed to a stacking area of the stacking unit 26. The notes of value to be fed are guided by a vane wheel 64.

The stacking unit 26 has a support element 66 on which the notes of value are stacked on top of each other to a value note stack. The support element 66 is arranged pivotably so that the value note stack 68, after the support element 66 has been pivoted upwards, can be transported by the second transport unit 24 to the output compartment.

The second transport unit 24 has a pushing plate 80 as well as belts 72, 74 guided over rollers 76. During the transport, the pushing plate 80 presses against the value note stack 68 so that it is transported in the direction of the output compartment. In particular, a drive unit 78, such as a motor, is provided for driving the transport unit.

Figure 3:
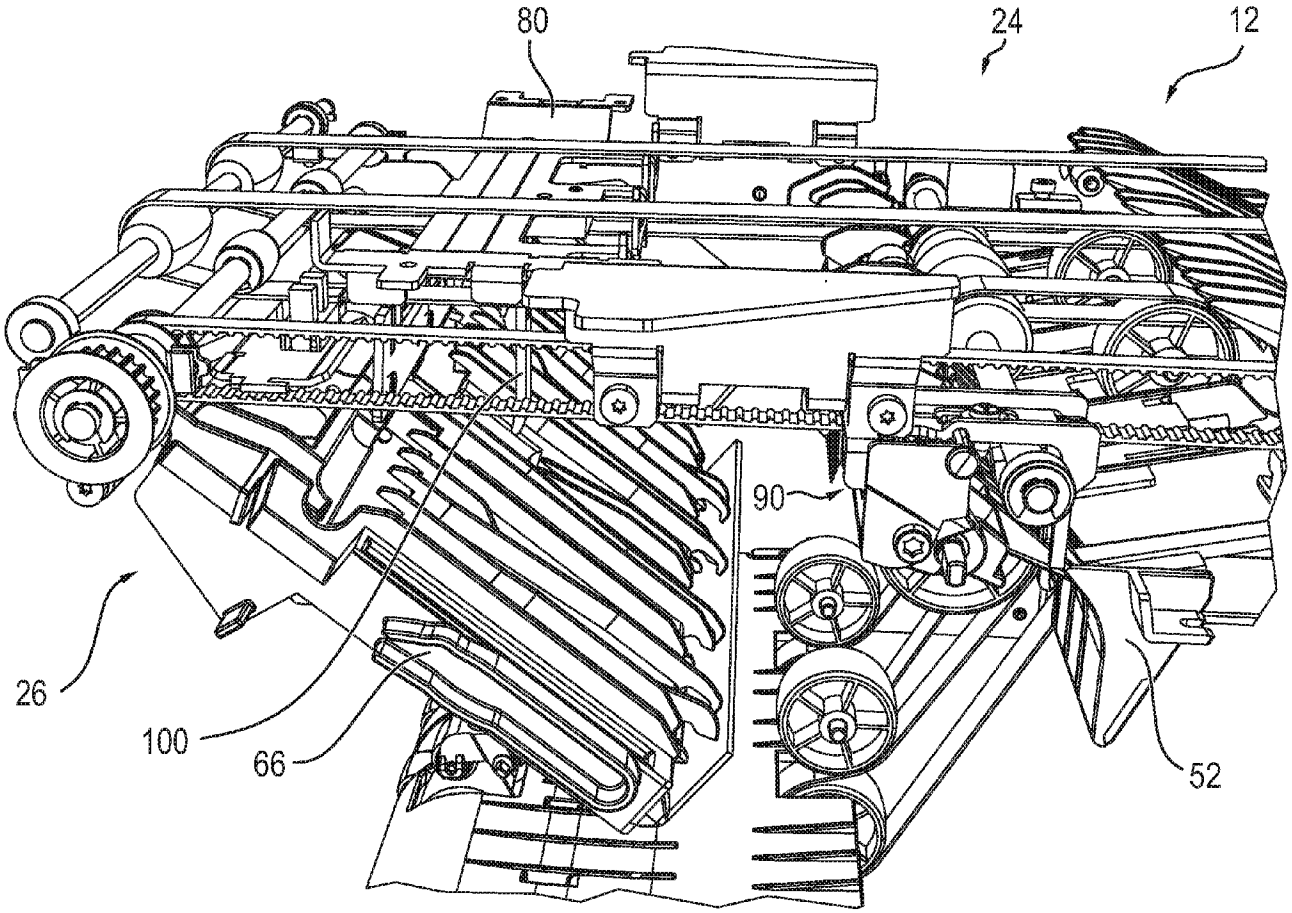
FIG. 3 is a schematic perspective illustration of the head module of the automated teller machine of FIG. 1.

With reference to FIG. 3, above the stacking unit 26, the second transport unit 24 including the pushing plate 80 is arranged. On the underside of the pushing plate 80, i.e. on the side which faces the stacking unit 26, a guide element 100 is arranged, which is designed in the form of a guide finger.

Figure 4:
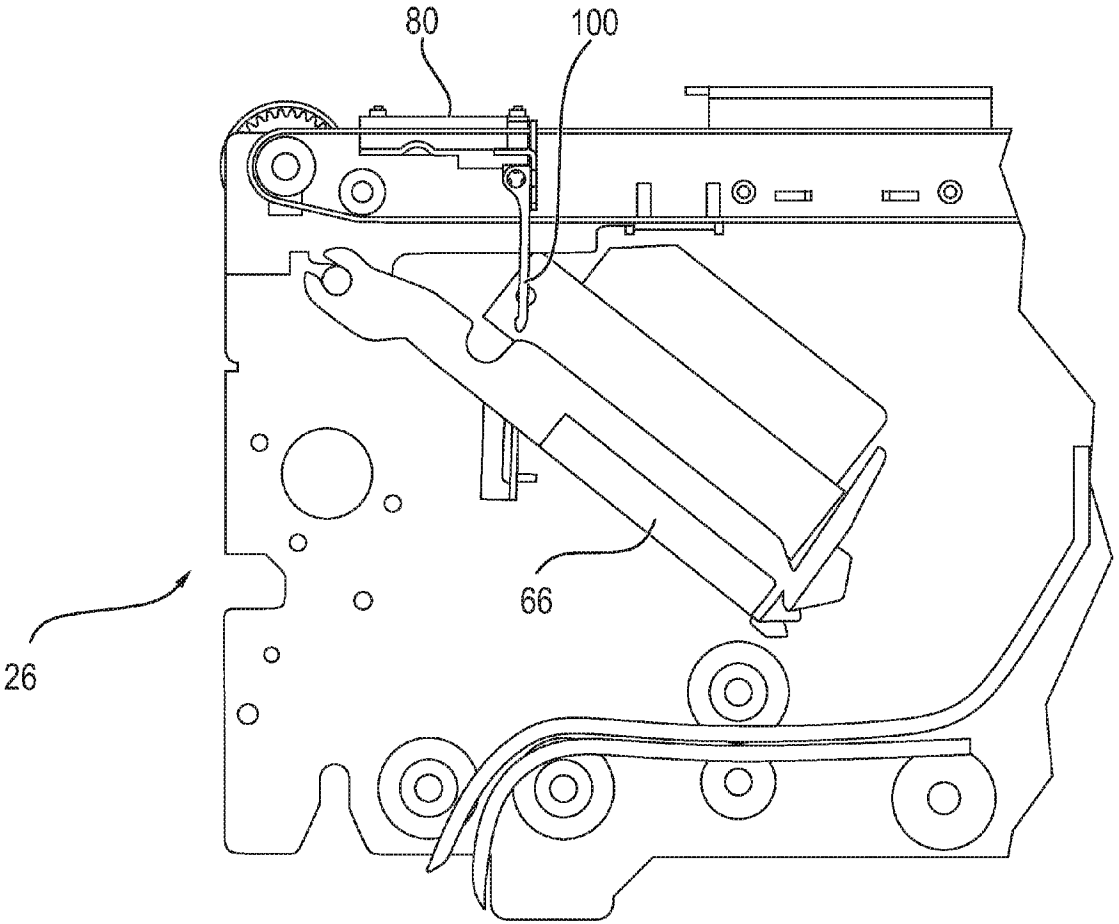
FIG. 4 is a sectional view of a detail of the automated teller machine of FIG. 1 with a pushing plate arranged in a first position.
Figure 5:
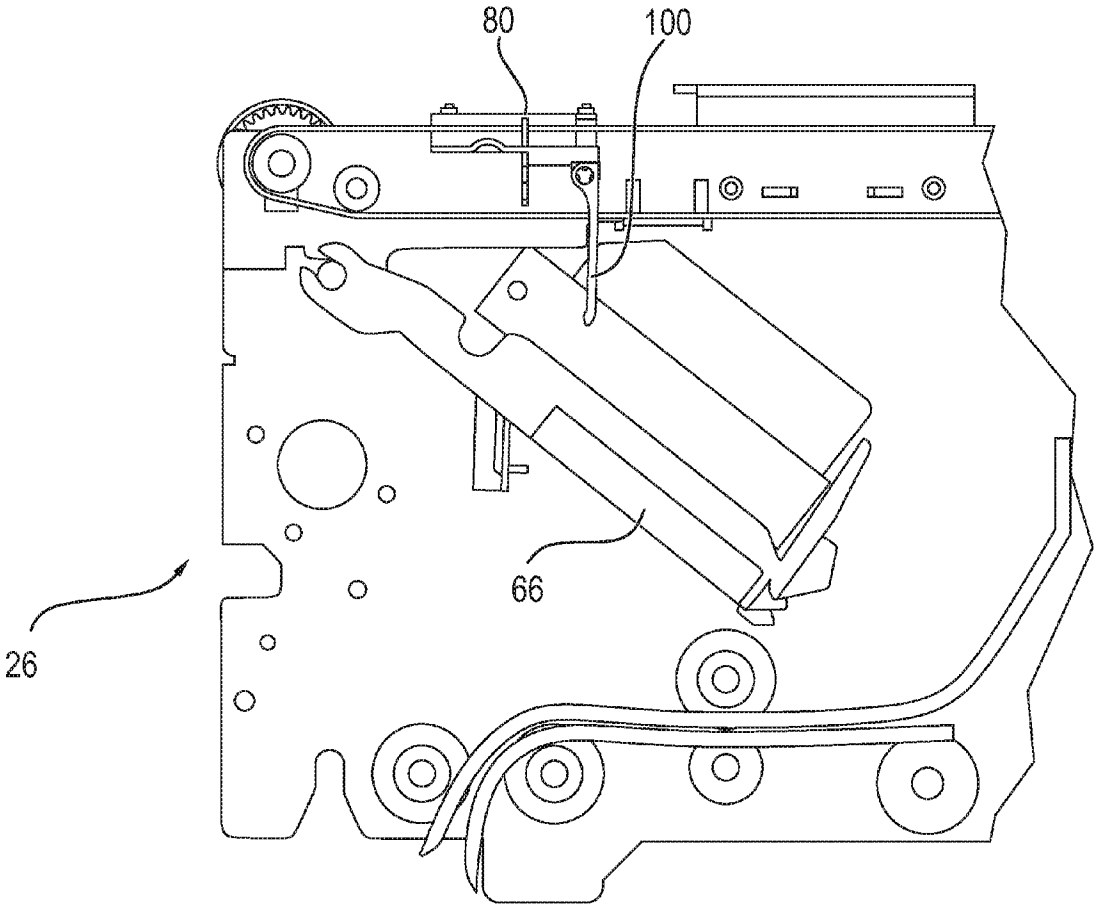
FIG. 5 is a sectional view of the detail of the automated teller machine of FIG. 4, with the pushing plate arranged in a second position.

The guide element 100 is thus moved together with the pushing plate 80 and can thus be arranged in different positions relative to the stacking unit 26, as shown in FIGS. 4 and 5.

The position into which the pushing plate 80 and thus also the guide element 100 is moved during the stacking of notes of value to a stack, i.e. during the stacking operation, is defined dependent on the size of the notes of value to be stacked. The larger the largest note of value to be stacked in a stacking operation, the larger the distance in which the guide element 100 is arranged relative to the feeding side 90 from which the notes of value are fed to the stacking unit 26 is chosen. When feeding the notes of value, these are fed against the guide element 100 so that, by the additional guidance via the guide element 100, an orderly deposit of the notes of value on the support element 66 or on top of one another is accomplished and a shifting of the notes of value both in lateral direction and in feed direction is prevented or at least reduced and thus a properly aligned value note stack is formed.

By mounting the guide element 100 on the pushing plate 80 it is achieved that for adjusting the guide element 100 neither a manual intervention is required nor an own separate adjusting unit has to be provided, but all can be accomplished by units already provided in the head module 12 anyway. Thus, an aligned value note stack can be obtained independent of the size of the notes of value, which size results dependent on the denomination and/or currency, and this stack can then be transported without any problems to the output compartment and can be output to the user.

A control unit 79, as best shown in FIG. 2, is provided, by which the second transport unit 24 and thus the pushing plate 80 are controlled. In this control unit 79, for different sizes, currencies and denominations and the resulting combinations, the respective position in which the guide element 80 should be arranged for an optimum guidance for stacking corresponding notes of value is stored. These positions may be calculated in advance and/or determined by experiment.

Prior to a stacking operation, the control unit 79 selects the assigned position dependent on the currency, denomination, and/or size of the notes of value to be stacked during this stacking operation, and moves the pushing plate 80 into this position.

Figure 7:
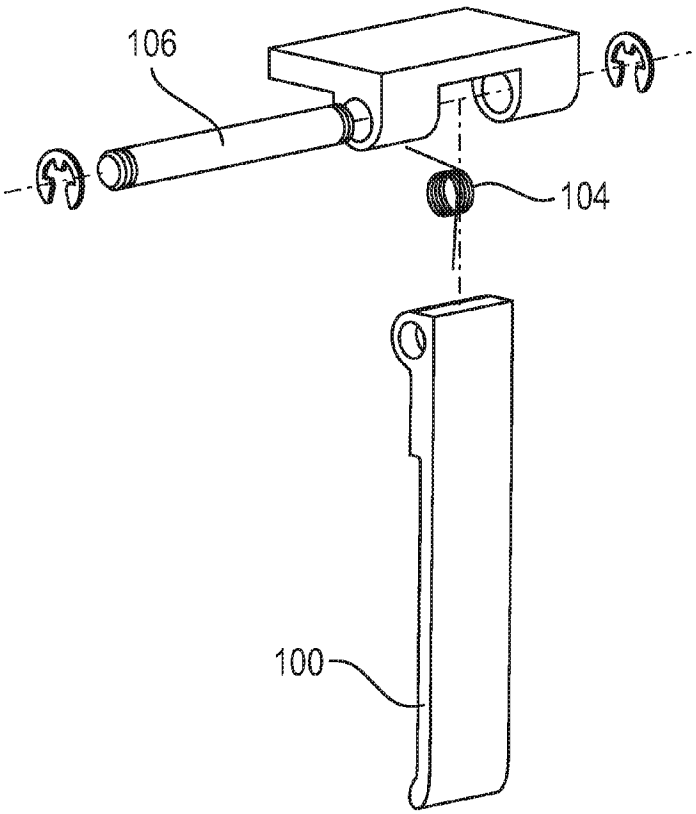
FIG. 7 is an exploded view of the guide element and the mounting element of FIG. 6.
Figure 6:
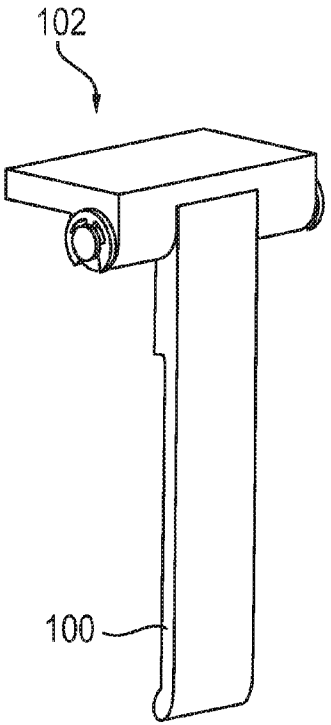
FIG. 6 is a schematic perspective illustration of a guide element and a mounting unit for mounting the guide element on the pushing plate, with the guide element arranged in a first position of the automated teller machine of FIG. 1.
Figure 8:
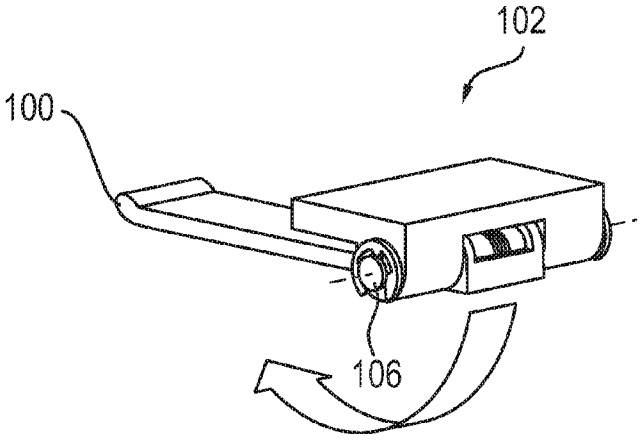
FIG. 8 is a schematic, perspective illustration of the mounting element and of the guide element of FIGS. 6 and 7 with the guide element arranged in a second position.

As best shown in FIGS. 6 to 8, the guide element 100 as well as a mounting unit 102 via which the guide element 100 is mounted on the underside of the pushing plate 80.

As best shown in FIG. 7, the guide element 100 is rotatably mounted on a shaft 106 so that it is articulated to the pushing plate 80. The guide element 100 is biased by a torsion spring 104 in a first position shown in FIG. 6. As an alternative to a torsion spring 104, also other elastic elements can be used for biasing.

In the first position, shown in FIG. 6, the guide element 100 is arranged such that it projects from the mounting unit 102 and thus also from the pushing plate 80, at an angle of about 90°. Thus, in this first position, the guide element 100 projects into the stacking area, provided that the pushing plate 80 is arranged in the area of the stacking unit 26, and can thus guide the notes of value to be stacked during the stacking operation.

Figure 9:
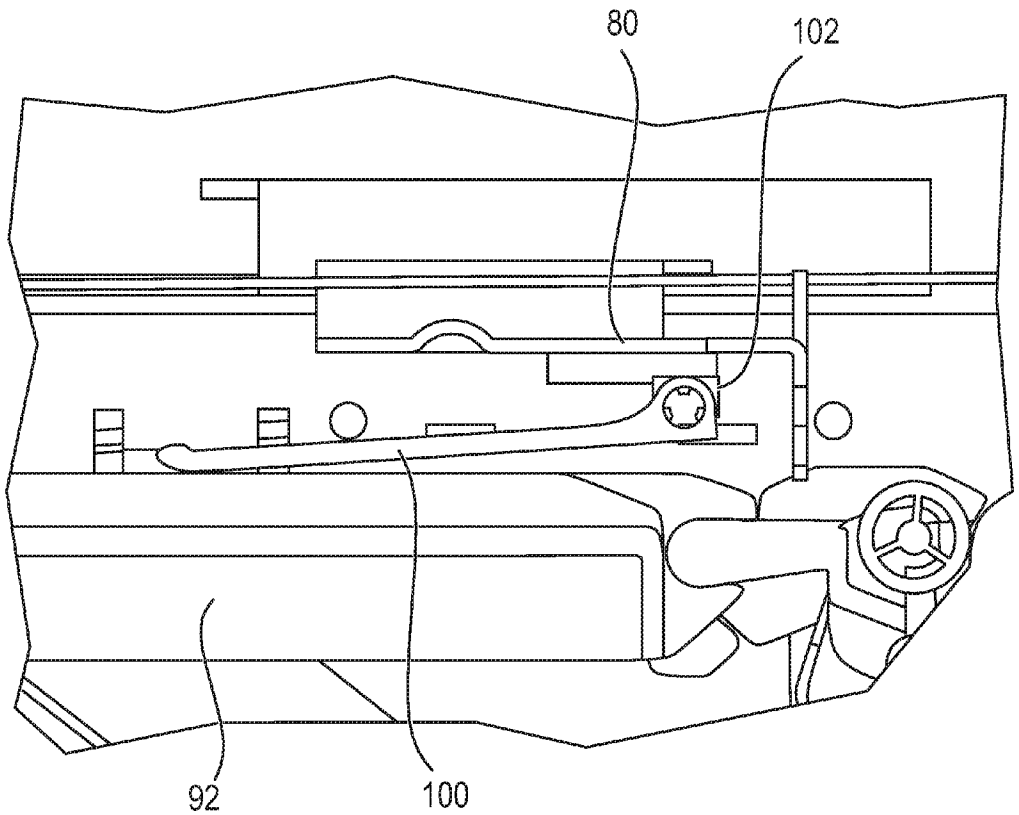
FIG. 9 is a sectional view of a detail of the automated teller machine of FIGS. 1-5.

As shown in FIG. 8, the guide element 100 can be rotated relative to the mounting unit 102 and thus relative to the pushing plate 80 from the first position, shown in FIG. 6, into the second position, shown in FIG. 8, against the restoring force of the torsion spring 104. This is preferred since upon moving the pushing plate 80 from the stacking unit 26 in the direction of the output compartment 28 not as much installation space has to be left free as might be required if the guide element 100 were arranged immovably on the pushing plate 80. The articulation makes it possible that, as shown in FIG. 9, the guide element 100 may be deflected upon contact with other component parts 92 of the automated teller machine 10. Thus, in the illustrated example, no more installation space is required than would be necessary if using a pushing plate 80 without the guide element 100.

By the biasing by the torsion spring 104 it is further achieved that the guide element 100 automatically reassumes the first position required for stacking when it is no longer in contact with the other components parts 92, which is the case when the pushing plate 80 has been moved back into the area of the stacking unit 26. Thus, for deflecting the guide element 100 during the transport of the notes of value by the pushing plate 80 no extra adjusting units necessarily have to be provided.

While principles and modes of operation have been explained and illustrated with regard to particular embodiments, it must be understood, however, that this may be practiced otherwise than as specifically explained and illustrated without departing from its spirit or scope.

What is claimed is:

1. A device for output of notes of value, comprising:

a stacking unit for stacking the notes of value removed from at least one value note receiving unit to a value note stack;

an output compartment for the output of the value note stack;

a pushing plate movable by a transport unit for transport of the value note stack from the stacking unit to the output compartment; and a guide element for guiding the notes of value during the stacking by the stacking unit;

where the guide element is mounted on the pushing plate.

2. The device according to claim 1, where the stacking unit is designed such that it feeds the notes of value to be stacked during a stacking operation against the guide element.

3. The device according to claim 1, where the device further comprises a control unit for controlling the transport unit, and that the control unit controls the transport unit such that the transport unit moves the pushing plate to different predetermined positions dependent on currency, denomination and/or size of the notes of value to be stacked.

4. The device according to claim 3, where the control unit controls the transport unit such that, prior to a stacking operation, the transport unit moves the pushing plate to a position predetermined for the stacking operation dependent on the currency, the denomination and/or the size of the notes of value to be stacked.

5. The device according to claim 3, where the control unit controls the transport unit such that the transport unit varies a position of the pushing plate during a stacking operation dependent on the currency, the denomination and/or the size of the notes of value to be stacked.

6. The device according to claim 3, where for several currencies, denominations, and/or sizes of notes of value and/or for combinations of these parameters, the respective predetermined position in which the pushing plate is to be arranged during the stacking of notes of value of the corresponding currency, denomination and/or sizes or combinations is stored in the control unit in a clearly assigned manner, that the control unit reads out the corresponding position dependent on the currencies, the denominations and/or the sizes of the notes of value to be stacked, and that the control unit controls the transport unit such that it moves the pushing plate into the position.

7. The device according to claim 6, where when the value note stack to be formed includes notes of value of different currencies, denominations and/or sizes, the control unit selects the position of the positions predetermined for the different currencies, denominations and/or sizes for which a distance between the pushing plate and a feeding unit for feeding the notes of value to the stacking unit is largest.

8. The device according to claim 1, where the guide element is articulated to the pushing plate.

9. The device according to claim 1, where the guide element is mounted on the pushing plate such that it is movable between a first position and a second position in which it is rotated relative to the first position relative to the pushing plate by a predetermined angle.

10. The device according to claim 9, where the predetermined angle is between 60° and 100°.

11. The device according to claim 9, where the guide element rests against the pushing plate in the second position.

12. The device according to claim 9, where the guide element is arranged in the first position when the pushing plate is arranged in a position in which the pushing plate is arranged during the stacking of the notes of value.

13. The device according to claim 9, where the guide element is biased in the first position.

14. The device according to claim 13, where the device is designed such that the guide element is moved by contact to other elements of the device opposite to the biasing from the first into the second position when the transport unit moves the pushing plate from the stacking unit to the output compartment.

15. The device according to claim 1, where the guide element is shaped in form of a finger.

16. The device according to claim 10, where the predetermined angle is between 80° and 90°.

17. The device according to claim 13, where the guide element is biased in the first position by a spring.

* * * * *